US005620489A

United States Patent [19]

Tselesin

[11] Patent Number: 5,620,489

[45] Date of Patent: Apr. 15, 1997

[54] METHOD FOR MAKING POWDER PREFORM AND ABRASIVE ARTICLES MADE THEREFORM

[75] Inventor: Naum N. Tselesin, Atlanta, Ga.

[73] Assignee: Ultimate Abrasive Systems, L.L.C., Atlanta, Ga.

[21] Appl. No.: 594,388

[22] Filed: Jan. 31, 1996

Related U.S. Application Data

[63] Continuation of Ser. No. 225,251, Apr. 8, 1994, abandoned.

[51] Int. Cl.[6] ..... B24D 18/00

[52] U.S. Cl. ..... 51/293; 51/298; 51/299

[58] Field of Search ..... 51/293, 298, 299

[56] References Cited

U.S. PATENT DOCUMENTS

| | | | |
|---|---|---|---|
| 2,268,663 | 9/1942 | Kuzmick | 51/297 |
| 2,811,960 | 2/1957 | Fessel | 51/309 |
| 2,876,086 | 3/1959 | Raymond | 51/298 |
| 3,127,715 | 4/1964 | Christensen | 451/541 |
| 3,276,852 | 10/1966 | Lemelson | 51/298 |
| 3,860,400 | 1/1975 | Prowse et al. | 51/298 |
| 4,317,660 | 3/1982 | Kramis | 51/295 |
| 4,409,054 | 10/1983 | Ryan | 156/293 |
| 4,634,453 | 1/1987 | Hay et al. | 51/293 |
| 4,652,277 | 3/1987 | Makhlouf et al. | 51/293 |
| 4,680,199 | 7/1987 | Vontell et al. | 427/199 |
| 4,925,457 | 5/1990 | deKok et al. | 51/293 |
| 4,949,511 | 8/1990 | Endo et al. | 51/295 |
| 5,049,165 | 9/1991 | Tselesin | 51/295 |
| 5,092,910 | 3/1992 | deKok et al. | 51/295 |
| 5,094,671 | 3/1992 | Hall et al. | 51/293 |
| 5,143,523 | 9/1992 | Matarrese | 51/293 |
| 5,160,509 | 11/1992 | Carman et al. | 51/296 |
| 5,190,568 | 3/1993 | Tselesin | 51/293 |
| 5,203,880 | 4/1993 | Tselesin | 51/293 |
| 5,203,881 | 4/1993 | Wiand | 51/293 |
| 5,221,294 | 6/1993 | Carman et al. | 51/296 |
| 5,264,011 | 11/1993 | Brown et al. | 51/309 |

FOREIGN PATENT DOCUMENTS

| | | |
|---|---|---|
| 0204195 | 12/1986 | European Pat. Off. . |
| 0238434 | 9/1987 | European Pat. Off. . |
| 0242955 | 10/1987 | European Pat. Off. . |
| 0294198 | 12/1988 | European Pat. Off. . |
| 0407069A3 | 1/1991 | European Pat. Off. . |
| 0533443A1 | 3/1993 | European Pat. Off. . |
| 2029390 | 10/1970 | France . |
| 2565870 | 12/1985 | France . |
| 0086086A2 | 8/1983 | South Africa . |
| 2275690 | 8/1994 | United Kingdom . |

OTHER PUBLICATIONS

Electronics: Tape Casting, Roll Compaction, Theodore P. Hyatt, The American Ceramic Society Bulletin, vol. 74, No. 10, Oct. 1995, pp. 56–59.

*Primary Examiner*—Deborah Jones
*Attorney, Agent, or Firm*—Finnegan, Henderson, Farabow, Garrett & Dunner

[57] ABSTRACT

A method for making abrasive articles uses a soft, easily deformable and flexible preform having a high binder content. The binder gives the preform its integrity, and is present in greater quantity than the retaining powder. The preform can have superabrasive particles mixed therein, or added later. The preform allows even distribution of a small quantity of retaining powder for thin superabrasive articles. A porous layer may be added to the assembly for making an abrasive article, the porous layer absorbing the liquid binder, supporting the retaining powder and superabrasive particles to prevent lateral movement, and perhaps giving strength to the preform. The final assembly to be heated or sintered (preferably under pressure) for making the abrasive article, which may include any number of layers of superabrasive particles, porous layers and preforms.

62 Claims, 5 Drawing Sheets

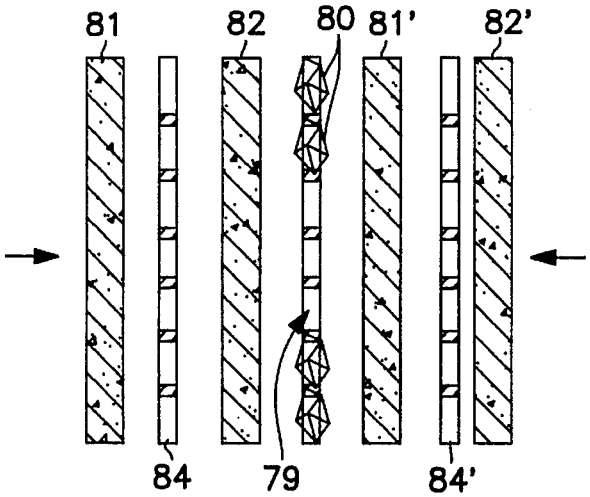
FIG. 22
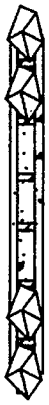
FIG. 23
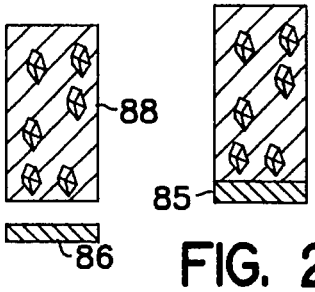
FIG. 24
FIG. 25
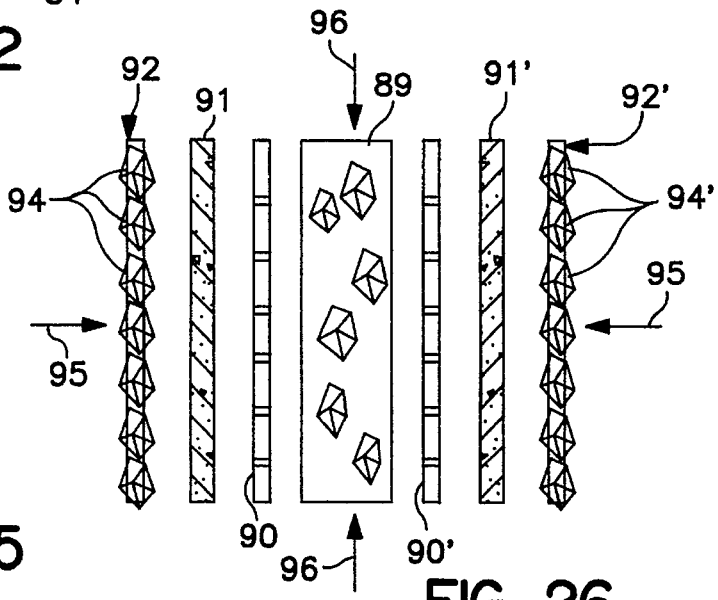
FIG. 26
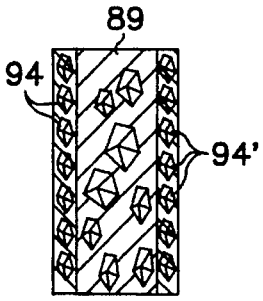
FIG. 27
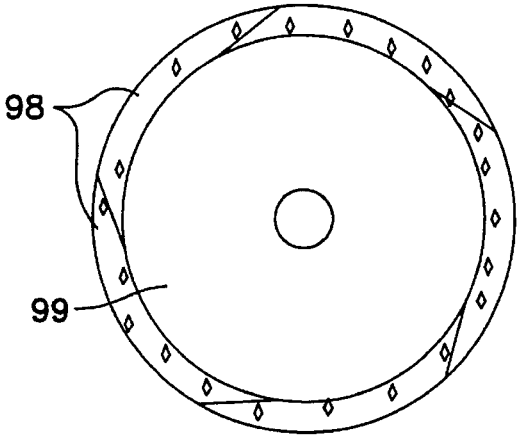
FIG. 28

METHOD FOR MAKING POWDER PREFORM AND ABRASIVE ARTICLES MADE THEREFORM

This application is a continuation of U.S. patent application Ser. No. 08/225,251 filed Apr. 8, 1994, now abandoned.

BACKGROUND OF THE INVENTION

1. Field of the Invention

This invention relates generally to the making of abrasive articles and the like, and is more particularly concerned with the use of soft, flexible and easily deformable powdered pieces as preforms for the manufacture of abrasive articles having abrasive particles therein.

2. Discussion of the Prior Art

Powdered preforms are widely used in the manufacture of abrasive articles that include a plurality of abrasive particles such as diamond, cubic boron nitride and the like. Such powdered preforms are conventionally manufactured by compacting powder mixtures of retaining compositions and superabrasives particles in cold presses or roll compactors to form green compacts. Compacting pressure ranges from 300 to 10,000 kg/sq. cm, resulting in 20–50% relative density of the green compacts. Such green compacts are hard, stiff and brittle. The green compacts are then sintered, either with or without pressure, and with or without impregnation.

There is a method of making abrasive articles wherein a non-compacted mixture of the powdered retaining composition, with a plurality of abrasive particles therein, is placed directly into a sinter mold, then compacted and sintered in the sinter mold. This method requires a lot of adjustments in attempts to spread the powder evenly within the sinter mold. The required adjustments slow the manufacturing process, so the method does not fit well with mass production requirements.

In all the above mentioned methods, the powdered mixture can contain some binders, but the conventional green compacts are held together, not by the binder, but primarily by interaction among the particles of the powder, e.g. by mechanical interlocking of the particles. The above mentioned methods are widely used to produce traditional cutting, drilling, and grinding abrasive tools and elements of abrasive tool, such as segments for saws and the like.

There are powdered preforms formed by spraying powder onto a substrate, and fixing the powder to itself and to the substrate by an adhesive, for example by an adhesive spray. Such preforms are flexible, but may experience loss of some powder when flexed. Also, such a method must deal with air borne particles and aerosol sprays that, because of environmental concerns, put serious limitations on the implementation of the method. This method has been used by the present inventor to make articles disclosed in U.S. Pat. Nos. 4,925,457, 5,049,165, 5,092,910 and 5,190,568, as well as in U.S. patent application Ser. No. 08/066,475 titled "Patterned Abrasive Material and Method", and U.S. patent application Ser. No. 08/024,649 titled "Abrasive Cutting Tool".

Soft and flexible preforms of powders and/or fibers, including both metallic and non-metallic materials, are also known; but, to the knowledge of the present inventor, such preforms are not known in the art of manufacturing articles that include abrasive particles. Presently, the soft and flexible preforms are made by casting, or extruding a composition of brazing filler metal, or ceramic components, or hard facing compositions including metallic components and non-metallic components such as tungsten carbide particles. Such soft and flexible preforms can be bent more than 90°, and can be cut by scissors or the like.

The earlier known soft and flexible preforms comprise a high content of various binders, up to 95% by volume, and up to 20% by weight. It is the binder that makes such preforms soft and flexible; but, even with the high content of binders, the preforms are flimsy and must be handled with care. This is especially true for the very thin preforms, around 0.005–0.010", or 0.10–0.25 mm.

It is important to distinguish between the soft and flexible preforms and the products of roll compacting of powders, even in the presence of a binder. When a roll compacted product includes a binder, the binder is in a much smaller quantity than in a flexible preform. The roll compacted product is held together, not by the binder, but by the mechanical interlocking of particles, which makes the roll compacted product much less flexible than the soft and flexible preforms.

Soft and flexible preforms made of brazing filler metal compositions are used to put some parts together through brazing, mostly through furnace brazing. Soft and flexible preforms made for hard facing compositions are used to repair worn parts. For this purpose, the preforms are applied to a worn spot on the part.

The brazing process using the soft and flexible preforms made of brazing filler metal has a significant time duration because of the necessity for removal of the substantial quantity of binder. The time for removal of the binder is called the "dewaxing" cycle, and it allows the binder to melt, evaporate, or run out from the preform. It has been found that, if the dewaxing time is shortened or omitted, the powder of the soft and flexible preform can be literally washed out by the liquefied binder.

In attempting to use the known soft and flexible preforms to hold a plurality of abrasive particles in order to produce abrasive articles, it will be recognized that:

1. Compositions of the brazing filler preform do not correspond to the desired matrix compositions to hold abrasive particles;
2. Soft and flexible preforms are not produced with abrasive particles on, or within, the preforms;
3. Soft and flexible preforms are quite flimsy and not as strong as desired for production of abrasive articles, especially for mass production requirements of abrasive articles requiring thin (0.005–0.020", or 0.1–0.5 mm) flexible preforms;
4. De-waxing time must be severely reduced to meet production rates, especially for mass production; and,
5. Heating and/or brazing processes alone do not provide the most reliable matrix for retaining abrasive particles.

SUMMARY OF THE INVENTION

The present invention provides a method for manufacturing abrasive articles and wear resistant parts, such articles or parts comprising a plurality of abrasive particles also known as superabrasive particles such as diamond, cubic boron nitride or the like randomly or systematically distributed in a sintered retaining matrix. specifically, the method of the present invention includes the preparation and utilization of powdered preforms in the form of soft, easily deformable flexible (SEDF) bodies that may include a plurality of abrasive particles.

In making the SEDF preforms, the powdered sinterable compositions will be chosen based on criteria related to the holding necessary for the abrasive particles to be included. Any number of sinterable matrix materials, or powdered compositions may be used. The binder compositions in the form of a liquid that includes a cement in combination with a thinner for the cement will be selected to provide the desired integrity of the final SEDF preform, while maintaining its flexibility and processability. To form an SEDF preform, a slurry or paste is formed of the powdered composition and the binder composition. The concentration of powdered composition and abrasive particles (if included) in the slurry or paste is low, and the volume of the binder composition is high. In fact, the volume of the binder composition or binder phase in the mixture substantially exceeds the volume of the powdered composition and the abrasive particles. Following formation of a substrate with the slurry, the substrate is solidified and cured at room temperature or with heat to evaporate most if not all of the volatile components of the binder phase and form a SEDF preform.

In one preferred form of the present invention, a porous layer is placed against the SEDF preform. The purpose of the porous layer is to hold the abrasive particles in place during subsequent processing of the material. successful material can be made without the porous layer, but the porous layer provides a better quality product than is obtained without the porous layer.

Final processing of the SEDF preform of the present invention includes sintering or other heat treating. The result is a high quality abrasive material, with or without a porous layer therein, which can be used for numerous cutting or abrasive tools and the like.

BRIEF DESCRIPTION OF THE DRAWINGS

These and other features and advantages of the present invention will become apparent from consideration of the following specification when taken in conjunction with the accompanying drawings in which:

FIGS. 22 and 23 are similar to FIGS. 20 and 21 but showing a modification thereof;

FIGS. 24 and 25 and FIGS. 26 and 27 are similar to FIGS. 20 and 21 but showing additional modifications thereof; and FIG. 28 is a side elevational view showing the assembly of a cutting tool in accordance with the present invention.

DETAILED DESCRIPTION OF THE EMBODIMENTS

Figure 1:
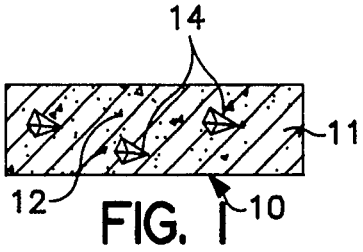
FIG. 1 is a cross-sectional view showing one form of a substrate from which an SEDF preform is made in accordance with the present invention, the substrate having some abrasive particles therein.

Referring now more particularly to the drawings, and to those embodiments of the invention here presented by way of illustration, the invention has two major parts: preparation of soft, easily deformed flexible (SEDF) preforms; and, utilization of SEDF preforms for making abrasive articles.

Preparation of Preform

The preform is prepared by mixing a binder composition with a sinterable powdered composition or matrix retaining material in the required proportions. The mixture may or may not include a plurality of abrasive particles. Thus, depending on the particular proportions chosen, one may produce the binder-powder mixture in the form of a slurry or a paste.

Mixing the liquid binder composition with the retaining powder or sinterable matrix material can be performed on a variety of standard equipment, including virtually any equipment suitable for mixing powder and liquid together. Thus, no detailed discussion of the equipment is necessary herein.

There is a variety of materials that can be used as the binder composition for the preform. The binder composition may be organic or inorganic, but should be selected to carry the particles of the powder, keep the particles suspended, and provide integrity and flexibility to the final preform. It is preferable to choose a binder composition that allows air, a low vacuum, heat, or a combination of these, to evaporate at least some of the volatile components of the binder composition for at least partial curing of the binder composition. Such binder compositions include water soluble cement.

It is well recognized that the prior art powder technology requires that a person mix powders and abrasive particles. Such powders and abrasive particles become air borne, and are deleterious to the health of workers. Safety masks and the like are available, but are uncomfortable to wear, and of course are not totally effective. The present invention overcomes this difficulty with the prior art in that the powders and abrasive particles can be handled by machines, appropriately covered to minimize the escape of particles. The material is available to be manipulated by people only after mixing powdered components with the liquid binder composition, so there is no longer a hazard of air borne particles.

Those skilled in the art will understand that many materials will be acceptable as binder compositions, depending on the precise characteristics desired. However, by way of example, the following have been found to be suitable binder compositions: Sanford's Rubber Cement (commercially available from Sanford Corporation, Bellwood, Ill.) in a combination with Carter's Rubber Cement Thinner (commercially available from Dennison Carter's Division, Dennison Manufacturing Company, Framington, Mass.); Nicrocoat Cements (available from Wall Colmanoy Company, Madison Heights, Mich.) in a combination with Exosen No. 40 as a thinner therefor (available from Smithkline Beckman Company, Lewistown, Pa.).

In the binder-powder mixture, the binder composition is usually 3 to 20% by weight of the mixture, but the ratio can be extended. By volume, the percentage of the powder within the binder-powder mixture is usually from 1 to 5%, but it can be extended to a range of 0.3 to 10%. One successful preform has been formed from a binder-powder mixture or slurry containing from 5.0 to 8.5% by weight of a binder composition consisting of rubber cement and thinner. The sinterable retaining powder is dispersed in the liquid binder composition and held thereby. Abrasive particles may also be dispersed within the binder, and also held therein.

Referring to FIG. 1 of the drawings, it will be seen that the substrate 10 from which a final SEDF preform of the invention can be made following evaporation of the volatile components such as thinner comprises mostly binder composition 11. There is a plurality of particles 12 of a sinterable retaining powder distributed in the binder composition 11, and there are abrasive particles 14 also distributed in the binder composition. From the above discussion it will be understood that the abrasive particles 14 may or may not be included. This will also be discussed in more detail below.

Figure 2:
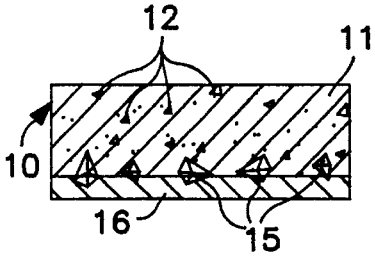
FIG. 2 is a cross-sectional view of another substrate made in accordance with the present invention, the substrate being formed on a layer which may be a layer of porous material.

Looking at FIG. 2, it will be seen that the substrate 10 comprises the binder composition 11 and retaining powder 12. Abrasive particles 15 are here shown as fixed to a layer 16, the layer 16 then being placed against the substrate 10. The layer 16 may take many forms, including a film having a low melting point or the like, but it is preferably a porous material, which will be discussed in more detail hereinafter.

Figure 3:
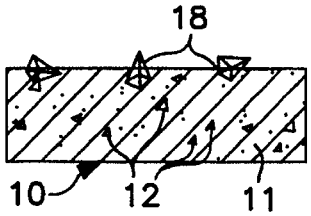
FIG. 3 is a view similar to FIG. 1 but showing the abrasive particles on the surface of the substrate.
Figure 4:
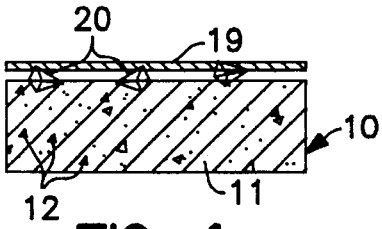
FIG. 4 is a view similar to FIG. 3 wherein the abrasive particles are held by a carrier which is placed against the substrate.

FIG. 3 shows a modification of FIG. 2, the substrate 10 being substantially the same. The abrasive particles 18 in FIG. 3, however, are placed on the upper surface of the substrate 10. The abrasive particles may be pressed into the substrate 10, or may be held by an adhesive. The adhesive may be the binder composition 11 of the substrate, or may be a separately applied adhesive. Similarly, FIG. 4 shows the arrangement of FIG. 3, but with a carrier 19 having the abrasive particles 20 adhered thereto. The particles 20 on the carrier 19 can therefore be brought into contact with the substrate 10 when desired.

In accordance with the present invention, the substrates from which the SEDF preforms are made can be formed by spreading a binder-powder mixture on a surface. The mixture may be a slurry, or a paste. The mixture is then cured, e.g. dried, on the surface to remove the volatile components such as thinner and form the SEDF preform and one may use applied heat or pressure if desired.

In some cases, especially when the abrasive particles are substantially larger than the particles of the retaining powder, or the viscosity of the liquid binder composition is not balanced to suspend the abrasive particles, some measure must be taken to prevent separation or sedimentation of the abrasive particles after mixing has stopped. One might therefore pour immediately after mixing, or combine continuous mixing with simultaneous pouring or coating.

The abrasive particles in the substrates are not surrounded by closely packed particles of a retaining powder as in the traditional green compacts. Rather, the abrasive particles are suspended predominantly by the binder composition, and in contact with a very few particles of the sinterable retaining powder. This is illustrated in FIGS. 1–4 of the drawings.

Abrasive particles can be added to the substrate during the process of forming or curing the SEDF preform. By way of example, attention is directed to FIG. 5 of the drawings. A binder-powder mixture 21 is dispensed onto a support surface 22, and doctored to a uniform thickness by a doctor blade 24 to form a substrate 26. After the doctor blade 24, abrasive particles 25 are dispensed onto the surface of the substrate 26. It will be understood that the mixture 21 is not cured at the time the abrasive particles 25 are placed onto the substrate 26 of the mixture, so the particles will be adhered thereto. If desired, or necessary due to the viscosity of the substrate and the weight of the particles 25, pressure can be applied to assist in urging the abrasive particles 25 at least partially into the substrate 26. Also, additional adhesives or the like can be applied as needed. Following addition of the particles 25, the substrate can be cured to remove liquid volatile components from the binder composition and form a SEDF preform.

Figure 5:
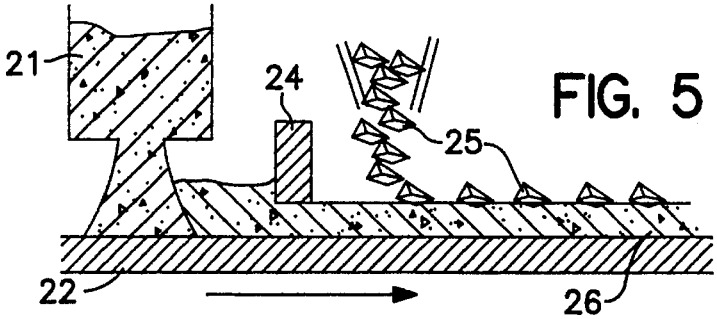
FIG. 5 is a cross-sectional view illustrating a continuous process for forming the substrate, and placing abrasive particles on one surface of it.
Figure 6:
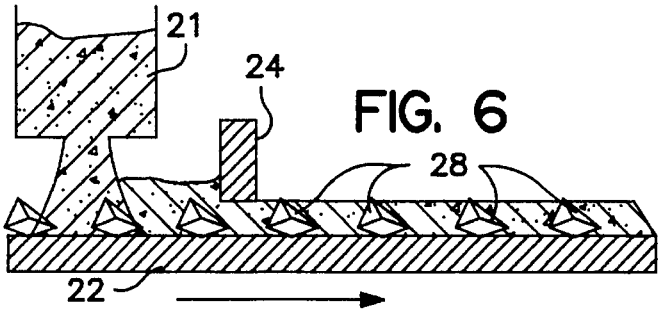
FIG. 6 is a view similar to FIG. 5, but showing the substrate being formed on a layer having abrasive particles thereon.

FIG. 6 illustrates a modification of the arrangement shown in FIG. 5. In FIG. 5, the binder-powder mixture 21 is dispensed onto the support surface 22 and doctored to the desired thickness by doctor blade 24. In FIG. 6, however, the support surface 22 carries a plurality of abrasive particles 28, and the binder-powder mixture is dispensed onto the particles 28. The abrasive particles 28 may be completely covered, or only partially covered by the binder-powder mixture as desired.

Figure 7:
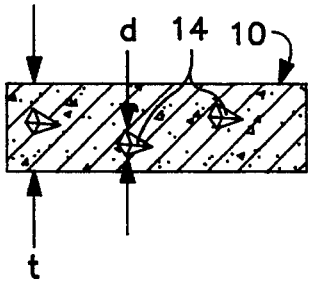
FIG. 7 is a view similar to FIG. 1 and showing a comparison between the thickness of the substrate and the size of the superabrasive particles.
Figure 8:
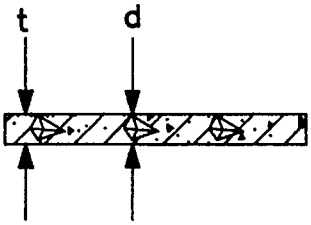
FIG. 8 shows the preform after sintering.

The difference between the thickness of the substrate and the size of the abrasive particles can vary considerably; but, it will be realized that the difference will change significantly in sintering. FIG. 7 shows a substrate 10 having abrasive particles 14 therein. At this stage, the thickness t of the substrate may be equal to 3d to 10d, where d is the dimension of the abrasive particles in the direction of the thickness of the substrate. After curing to form a SEDF preform and sintering, the same is shown in FIG. 8. It will of course be realized that the abrasive particles 14 will not change in size during sintering, but the preform will be significantly condensed. After sintering, the preferable ratio is that the thickness t is approximately equal to the dimension d, the desirable range being t=0.3–2d. It should be mentioned that abrasive particles of all sizes are suitable for use with the technology disclosed herein, but the preferable sizes are from 18 to 324 mesh (about 1.0 mm to about 0.035 mm).

The weight of the dry sinterable retaining powder per unit. volume of the SEDF preform (grams of powder per cubic centimeter of preform) determines the thickness of the sintered abrasive material, it being realized that the cement of the binder composition will run off, or evaporate, during sintering or other heat processing. For example, the density of cobalt is 8.9 g/cm$^3$, and a cobalt preform contains 0.8 g/cm$^2$ of the dry cobalt powder; therefore, the thickness of the fully densified, sintered product will be about 0.9 mm, which is found by dividing 0.8 g/cm$^2$ by 8.9 g/cm$^3$. It will be noted that the thickness of the SEDF preform is not in the calculation, this being irrelevant. The important consideration is the quantity of the dry powder per unit area of the preform.

Figure 9:
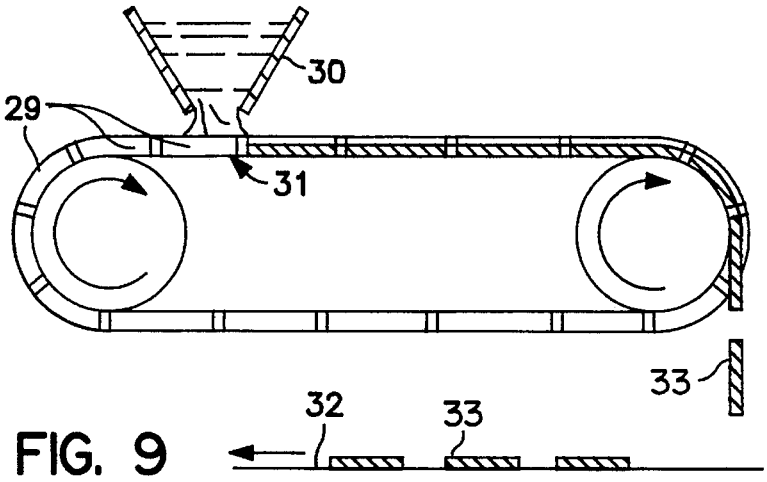
FIG. 9 is a cross-sectional view illustrating a method and apparatus for casting the substrates from which the preforms according to the present invention are made.

One technique for production of SEDF preforms of the present invention is—illustrated in FIG. 9. Essentially, a plurality of trays 29 is moved under a hopper 30 which dispenses the binder powder mixture. Each tray 29 will receive a predetermined quantity of the mixture to ultimately provide SEDF preforms of predetermined weight. As shown in FIG. 9, the trays 29 can be placed on a conveyor 31, or may be part of a conveyor 31 which can move continuously, or intermittently, and timed so the binder composition in the mixture will be cured before the SEDF preforms 33 are removed from the trays 29. In the system illustrated, the preforms 33 are received by another conveyor 32 which will carry the preforms to the next processing step. It should be understood that the conveyor 31 can take various geometrical arrangements, including a zig-zag shape in the horizontal plane and a stepped shape in vertical plane.

In using the system shown in FIG. 9, if an additional layer is desired on the preform, the layer, with or without abrasive particles thereon, can be placed in the bottom of the trays 29. Also, abrasive particles, with or without an additional layer, can be placed on top of the mixture in the trays 29 after the trays are filled to the desired extent.

It will therefore be realized that the SEDF preforms 33 may be made in the form of discrete plates as shown in FIG. 9, or may be made in the form of continuous tapes as shown in FIGS. 5 and 6. Either form can then be cut easily with scissors, paper cutter, die cutting or—the like.

Preparation of Abrasive Articles

Figure 10:
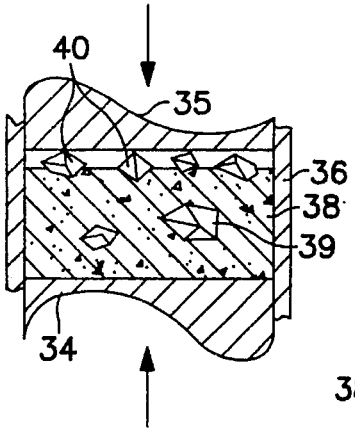
FIG. 10 is a cross-sectional view showing a process of sintering the preforms under pressure.

FIG. 10 of the drawings shows the preferred means and method for heating an SEDF preform and sintering the preform. FIG. 10 illustrates a generally conventional sinter fixture for sintering under pressure. It will be seen that there is a bottom punch 34 and a top punch 35, the space between the punches 34 and 35 being closed by the side plates 36. Within the cavity so defined, there is an SEDF preform 38, here shown as having abrasive particles 39 distributed therein, and a plurality of abrasive particles 40 on the top side of the preform 38.

Those skilled in the art will understand that the punches 34 and 35 will be urged towards each other as indicated by the arrows, and an electric current will be passed through the sinter fixture and/or the preform to heat the preform. An important feature of the present method is that the side plates 36 will tend to restrain lateral movement of the SEDF preform during sintering, even though there may be a flow of liquid as the cement of the binder composition and/or retaining matrix melt and run.

A further advantage of the SEDF preform in a sintering fixture as shown in FIG. 10 is that the softness of the preform makes redistribution of material quite easy. As a result, variations in thickness and stress can be made uniform simply through the usual pressure on the preform during sintering. The preform therefore has less sensitivity to various nonuniformities, and tends to reduce damage to the sinter molds. The inventor has experienced a 50-fold reduction in consumption of graphite mold parts since using the technique disclosed herein. It should be noted that, because of the softness and deform ability of the SEDF preform, abrasive articles with a corrugated shape can be mass produced without significant consumption of corrugated (hence expensive) punches, e.g. graphite or metal punches.

Figure 10A:
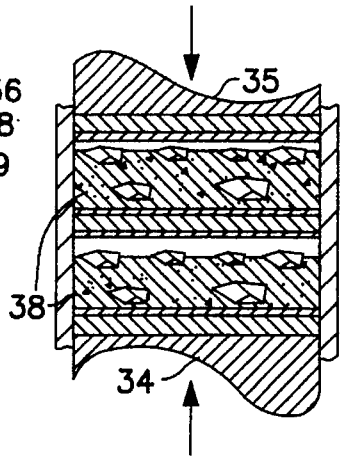
FIG. 10A is a view similar to FIG. 10 but showing a plurality of preforms within the mold.

It should be understood that the sinter mold can be loaded with several assemblies of SEDF preforms, the assemblies being separated from one another by punches and/or separators as disclosed in U.S. Pat. No. 5,203,880, "Method and Apparatus for Making Abrasive Tools", by the present inventor. Such sintering "in stock" is illustrated in FIG. 10A. The unique uniformity, softness and deform ability of the SEDF preform make sintering in stock acceptable for mass production technology.

While the heating of the SEDF preforms under pressure has many advantages, there is one severe disadvantage: the heating melts and vaporizes what is left of the binder composition, which runs; and, the liquid or vapor, intensified by the applied pressure, tends to carry the retaining powder and abrasive particles out of the mold. If most of the retaining powder is washed out of the mold, there will of course be practically no matrix material to hold the left over abrasive particles in place. Also, melted binder composition and/or melted or moved retaining matrix of SEDF preform will catch the abrasive particles, which can be washed out of the mold.

To solve the problem of the loss of retaining powder and abrasive particles, it has been found that a porous layer can be placed against the SEDF preform to prevent lateral movement of the particles. The porous layer may take many forms, but will not be held together by a binder as used in the SEDF preform. Rather, the porous layer may be screen wire, a conventional compacted preform, egg-crate or reticulated metal structures or the like.

Figure 11:
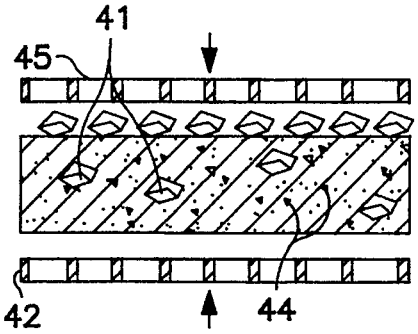
FIG. 11 is a cross-sectional view illustrating an assembly of a preform with porous layers in accordance with the present invention.

Looking at FIG. 11, it will be noticed that the abrasive particles 41 are larger than the openings in the porous layer 42. Under pressure, the particles 41 may cut into the porous layer 42. The particles 44 of the retaining powder are smaller than the opening in the layer 42, so these particles will pass easily into the openings of the layer 42.

As shown in FIG. 11, there is a second porous layer 45 on the opposite side of the SEDF preform; and, the assembly shown in FIG. 11 will be urged together and heated under pressure. The porous layers 42 and 45 will support the abrasive particles and prevent lateral movement (perpendicular to the direction of the applied compaction force), and will provide additional volume to receive the SEDF preform, and restrain lateral motion of the particles of retaining powder in the SEDF preform. The porous layers will also temporarily absorb liquid binder to reduce the flow of binder and thereby help prevent washout of retaining powder and abrasive particles.

Figure 12:
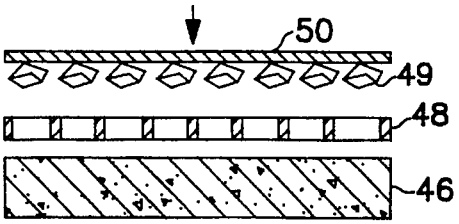
FIGS. 12–17 are similar to FIG. 11 and show various modifications thereof.
Figure 13:
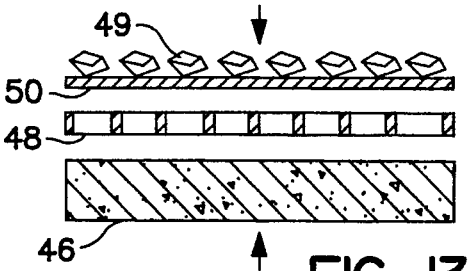

The porous layer, or layers, can be placed in various positions relative to the SEDF preform and other layers of an assembly to be sintered. By way of example, and not by way of limitation; FIG. 12 shows the SEDF preform 46 having a porous layer 48 on one side, and a layer of abrasive particles 49 on the opposite side of the porous layer 48, a substrate, or carrier 50 holding the particles 49 in place. FIG. 13 shows the same arrangement, but the substrate 50 is between the particles 49 and the porous layer 48.

Figure 14:
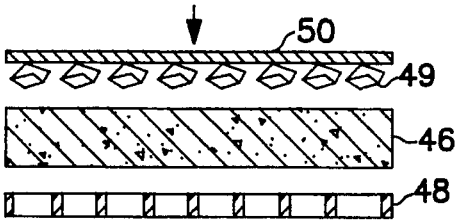
Figure 15:
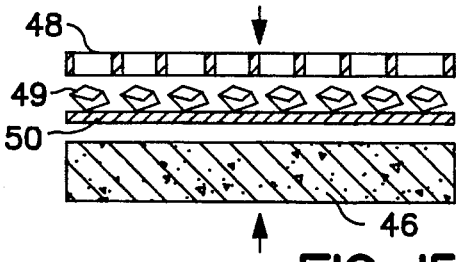
Figure 16:
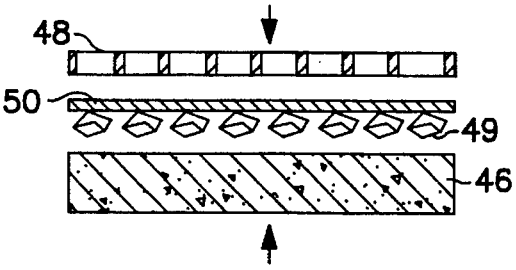

FIG. 14 shows the SEDF preform 46 in the middle with the porous layer 48 on one side, and the abrasive particles 49 and substrate 50 on the opposite side. FIG. 15 shows the abrasive particles 49 and substrate in the middle, with the SEDF preform 46 on one side, and the porous layer 48 on the opposite side. FIG. 16 is like FIG. 15, except that the positions of the abrasive particles 49 and the substrate 50 are reversed.

Figure 17:
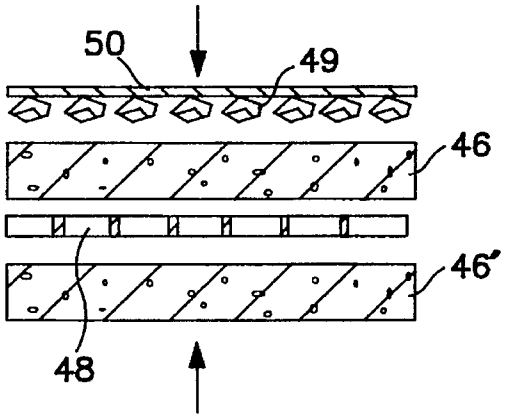

FIG. 17 shows two SEDF preforms 46 and 46'. A porous layer 48 is between the preforms, and the abrasive particles 49 with the substrate 50 are on the opposite side of one of the preforms.

The porous layer may take the form of a woven mesh, a nonwoven material, expanded foil, knitted materials and textile fabrics. Also, a material that is roll-compacted, extruded, sintered or the like can be used. Virtually any material can be used so long as the material is highly porous (about 30% to 99.5% porosity), having pores open to the surface and interconnected, with sufficient integrity to support the abrasive particles and to restrain motion of the retaining powder in the process of sintering.

Presently, the best material known for use as porous layers are metallic non-woven materials, and particularly a nickel fiber powder non-woven mat, manufactured by National Standard, Woven Production Division, Corbin, Ky., and sold under the trademark "Fibrex". The porosity of this mat is 85–98%; the fiber is 20 microns in diameter and is about 80 weight percent of the mat, while the powder is about 20 weight percent.

It has also been found that copper wire mesh, in the range of 20 to 200 mesh, works well as the porous layer. Some expanded metals (manufactured by Delker Corporation) have been used, for the same purpose.

Figure 18:
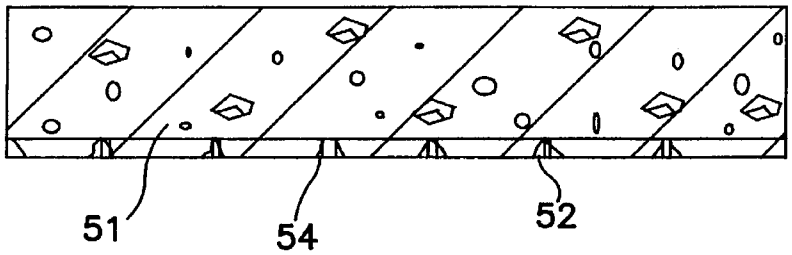
FIG. 18 is a cross-sectional view illustrating extrusion of the preform into openings of a porous layer.

FIG. 18 of the drawings illustrate an SEDF preform 51 after the preform 51 has been urged against a porous layer 52. The porous layer 52 is here shown as having some substantial thickness, and being made up of a plurality of cells 54 so the porous layer 52 comprises a cellular type of material. It will be seen, then, that the material of the preform 51 has been urged into the cells 54. It has been found desirable in some cases to compress the preform 51 with the porous layer 52 prior to applying heat and pressure during sintering. The material of the preform 51, being received in the openings, or cells, 54 of the porous layer 42 tends to stay within the openings and not to move laterally.

It should be understood that the role of the porous layer 52 can be limited to the restriction of flow of the material of the SEDF preform 51. Thus, a porous layer 52 may be made of a material having a melting point below the sintering temperatures. In this case, after at least a portion of the binder composition has been removed from the preform in the process of heating, and the retaining powder is at least partially solidified, the porous layer will melt onto the preform, and thereby modify the retaining composition. For example, a cobalt-nickel SEDF preform may utilize a porous layer made of copper, bronze, brass, zinc, aluminum, or various combinations of these, as well as other porous layers.

Another function of a porous layer 52 may be conduction of heat and/or electricity during heating of the preform. For example, a mesh or expanded foil of copper will readily conduct heat or electricity to facilitate uniform heating. Further, the porous layer may include abrasive particles within the cells 54. A preform as shown in FIG. 18 may be placed against a porous layer 52 having abrasive particles therein, or the porous layer may be used as a substrate in an arrangement such as that shown in FIG. 6 of the drawings.

In any arrangement, it must be realized that, if the porous layer is filled with abrasive particles, the ability of the porous layer to absorb binder composition during heating is reduced. Thus, if one wish to provide a full, or nearly full, layer of abrasive particles through the use of a porous layer, an additional porous layer may be needed, or desired, to absorb the binder and prevent displacement of the retaining powder.

Figure 19:
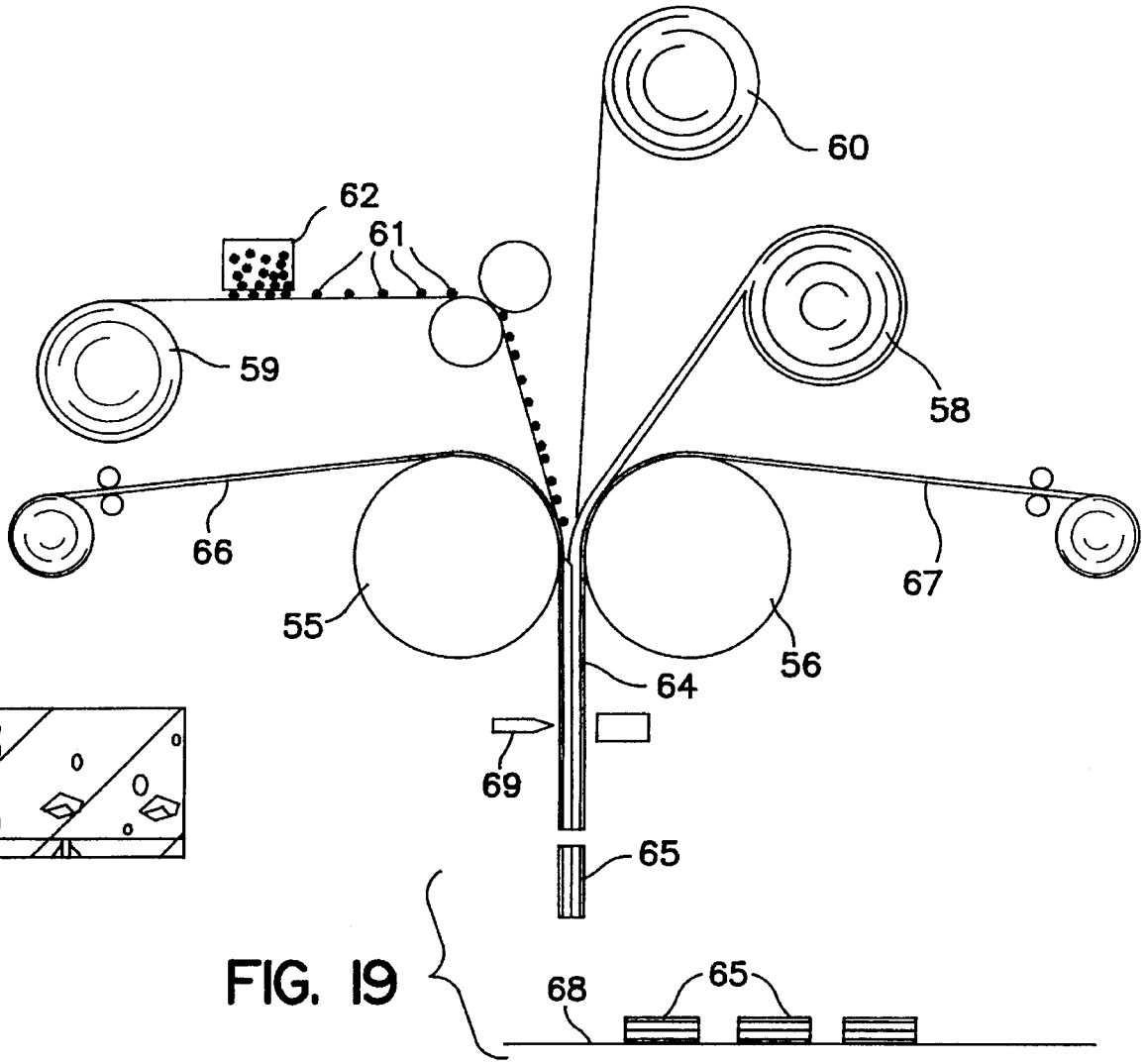
FIG. 19 is a cross-sectional view showing a continuous process for assembling a preform in accordance with the present invention using rolls.

Looking at FIG. 19 of the drawings, it will be seen that the SEDF preform of the present invention is admirably suited to mass production techniques. The arrangement shown in FIG. 19 includes rolls 55 and 56 for assembling a plurality of layers to be sintered. There is a roll of SEDF preform 58 to form one side of the assembly, and a roll of a carrier 59 to form the opposite side of the assembly. Optionally, a roll of a porous layer 60 is placed between the preform 58 and the carrier 59.

The carrier 59 may have a plurality of abrasive particles 61 previously placed thereon; or, as here illustrated, a dispenser 62 may place abrasive particles on the carrier 59 during the assembling process. In either case it is contemplated that the carrier 59 will have an adhesive to hold the abrasive particles 61 temporarily.

The SEDF preform 58 may take many forms as discussed above. The preform 58 may include a plurality of abrasive particles, or may not. Further, the preform may be placed on a supporting layer to give the preform greater integrity.

The porous layer 60 may or may not be included in the assembly. As is mentioned above, the preform 58 may utilize a porous layer and this may be sufficient for some products. However, if one or more additional porous layers are desired, they may be fed to the assembly as shown in FIG. 19. FIG. 19 also shows separators 66 and 67. Such separators are disclosed in U.S. Pat. No. 5,203,880, "Method and Apparatus for Making Abrasive Tools", by the present inventor. In accordance with the disclosure in that patent, these separators assist in protrusion of the abrasive particles through the retaining matrix, and in distribution of the temperature within the sinter mold during the sintering process. These separators 66 and 67 may or may not be attached to the SEDF preform assembly. When attached to the preform, the separators will be part of the assembly itself.

It should be understood that, in all techniques disclosed in the present application, separators such as the separators 66 and 67 may or may not be used. If separators are used, they may also be utilized as the surface on which the SEDF preforms are formed (see numeral 22 in FIGS. 5 and 6). It should be understood that, in the majority of the figures in the drawings, separators are not shown for the sake of simplification of the illustration.

Those skilled in the art will understand that the rolls 55 and 56 will urge the layers 58, 59 and 60, and separators 66 and 67 together into a single assembly 64. It is contemplated that the assembly 64 will then be cut into discrete pieces, or plates, 65 by a cutter 69. The individual plates 65 can be received by a conveyer 68 for transport to means for sintering.

Examples

Figure 21:
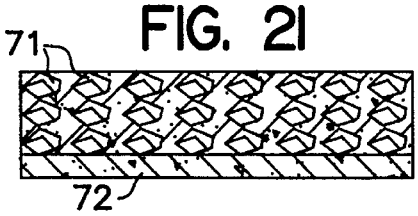
FIG. 21 is a cross-sectional view showing the assembly of FIG. 20 after assembly and sintering.
Figure 20:
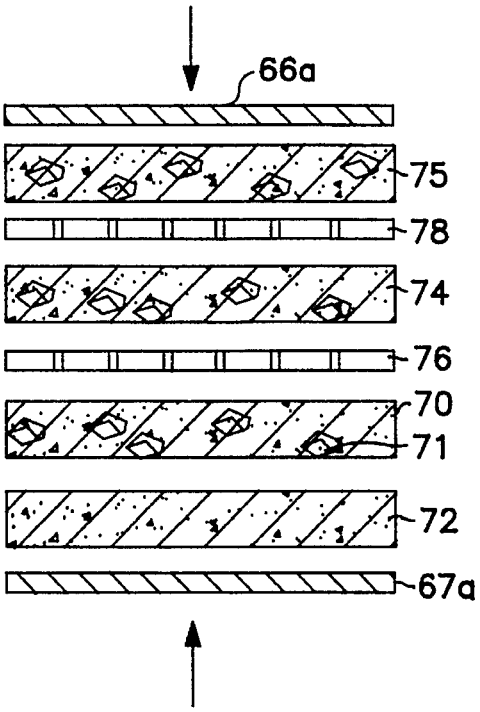
FIG. 20 is an exploded, cross-sectional view showing an assembly for producing an abrasive article.

FIGS. 20 and 21 of the drawings show one assembly and one resulting sintered abrasive material respectively in accordance with the present invention. There is an SEDF preform 75 having abrasive particles 71 distributed therein. On the opposite side of the assembly is an SEDF preform 72 without abrasive particles. Between these two outside layers, there are two additional preforms 70 and 74, both having abrasive particles distributed therein. Then, between the preforms 70 and 74 there is a porous layer 76; and between the preforms 74 and 75 there is a porous layer 78.

In FIG. 21 it can be seen that the abrasive particles remain in layers; and, on one side, the abrasive particles 71 are at the surface of the sintered assembly, while on the opposite side the preform 72 provides a backing without abrasive particles. This sintered abrasive material can now be used to manufacture cutting and grinding tools.

The SEDF preform may have a profiled shape, which may or may not correspond to the shape of a compacting means, e.g. punches used for providing pressure during sintering. The profiled SEDF preform, along with the non-profiled, or flat ones, are utilized by the present inventor for manufacturing abrasive articles according to U.S. Pat. No. 5,190,568 titled "Abrasive Tool with Contoured Surface".

Figure 19A:
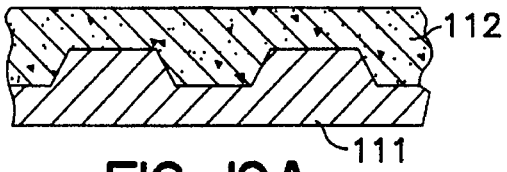
FIG. 19A is a cross-sectional view illustrating the casting of a profiled preform on a substrate.

FIG. 19A illustrates a one-sided profiled SEDF preform. One way to manufacture the one-sided profiled SEDF preform includes the use of a profiled substrate 111, the binder-powder mixture 112 being poured onto the substrate 111 and then cured to form an SEDF preform thereon.

Figure 19B:
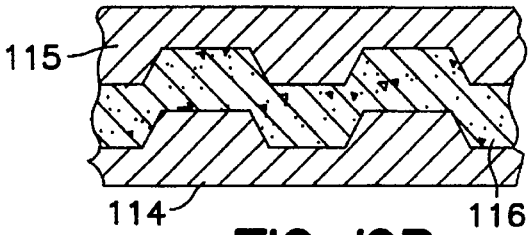
FIG. 19B is a view similar to FIG. 19A but showing a preform being cast between two substrates.

FIG. 19B, illustrates the formation of a two-sided profiled SEDF preform. FIG. 19B shows two substrates, or walls, 114 and 115 and a SEDF preform 116 between the walls 114 and 115. According to the method illustrated in FIG. 19B, the two-sided profiled SEDF preform is manufactured by pouring a binder-powder mixture in the form of a slurry between the two profiled walls 114 and 115, and then curing the slurry resulting in the formation of the two-sided profiled SEDF preform 116.

It should be understood that wall 114 and wall 115 may have different profiles, and each side of the SEDF preform has a profile corresponding to the profile (relief) of the respective wall. It also should be understood that the walls can be positioned vertically or horizontally; and, application of pressure and/or changing the distance between the walls in the process of solidification of the binder-powder mixture are optional.

Figure 19C:
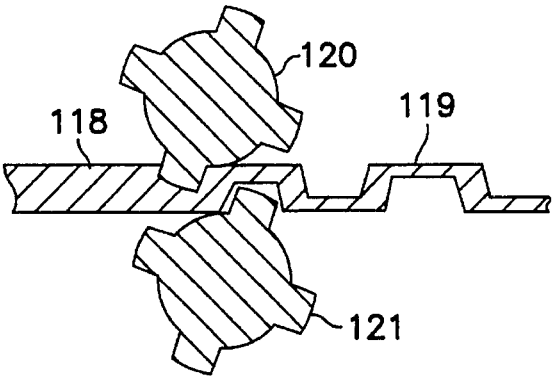
FIG. 19C is a cross-sectional view showing the deformation of a flat preform.

A non-profiled, or flat, SEDF preform can be converted prior to sintering into a profiled one. The flat profile 118 can be shaped between profiled compacting means. FIG. 19C illustrates one of the processes for shaping a flat SEDF preform 118 into a profiled SEDF preform 119 by two profiled rolls or gears 120 and 121. The preferable arrangement does not require change of the thickness of the SEDF preform as a result of the shaping. This type of shaping does not require very great pressure because of the easy deform ability of the SEDF preform.

FIG. 20 also, shows separators 66*a* and 67*a* placed against SEDF preforms 70 and 72 as a part of the assembly itself. FIG. 21 does not show these separators, indicating that at least some of the separators have been removed from the sintered abrasive material in the process of after-sintering cleaning, or in the process of dressing the abrasive tool.

Figure 20A:
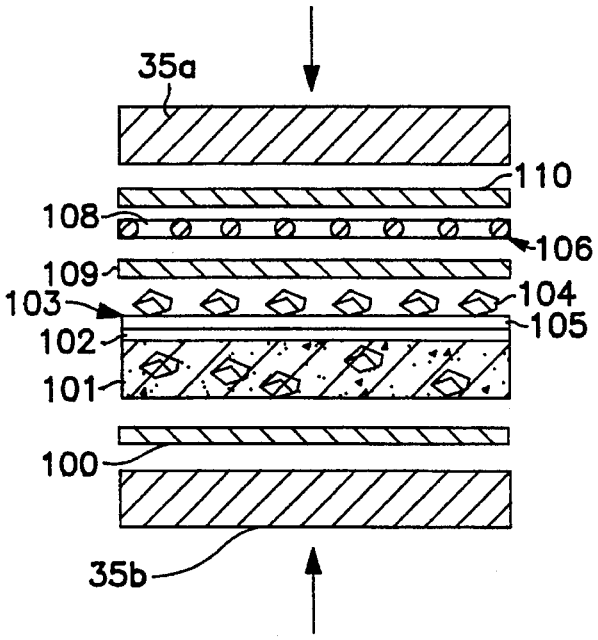
FIG. 20A is a view similar to FIG. 20 but showing a modification thereof.

One method for utilization of the separators in combination with the SEDF preform is shown in FIG. 20A. The separator 100 is placed on one side of the assembly 103 that includes an SEDF preform 101, a layer of porous material 102 and a layer of abrasive particles 104 on a carrier 105. A mesh type material 196 having openings 108 is applied against the separator 109; and, the preferable mesh type material 106 has orderly distributed openings 108. Under pressure provided by one or both of punches 35*a* and 35*b*, the assembly 103 extrudes at least partially into openings 108 of the mesh type material 106, deforming the separator 109 and leaving imprints on the surface of the assembly 103. The whole assembly 103 is put into the sintering mold as is shown in FIGS. 10 and 10A, and then sintered, providing that sintering under pressure is preferable. The pressure to extrude the assembly 103 into the openings 108 can be applied prior to sintering, outside of the sinter mold and/or within this sinter mold, and/or in the process of sintering. After sintering the mesh type material 106 is removed from the mold, as well as the separator 109. The removal of the mesh type material 106 from the sintered abrasive article is not a problem because the separator 109 prevents diffusion between the assembly 103 and the mesh type material 106. The resulting abrasive article will comprise a profile corresponding to the design of the mesh type material 106.

It should be understood that there are additional options (some being shown in FIG. 20A) that may or may not be implemented: the mesh type material 106 can be placed against both sides of the SEDF preform 101 for making two-sided profiled abrasive article (see separator 100 in FIG. 20A); another separator 110 can be used to separate mesh type material 106 from the punch 35*a*, and separator 100 can be used to separate another side of the assembly 103 from the punch 35*b*. It also should be understood that several assemblies comprising SEDF preforms and the mesh material for extrusion can be sintered in stock as is shown in FIG. 10A. Furthermore, separators of different thicknesses and different types can be used for opposite sides of the SEDF preform 101. The mesh type material 106 for extrusion can be made from different materials, e.g. steel woven mesh, expanded metal, machined crags, honeycomb or the like. It is also preferable that openings in the mesh 106 be big enough to allow at least one abrasive particle 104 to go therethrough. For example, diamonds have sizes of 0.015 to 0.200 mm (80–100 mesh) while the mesh type material for extrusion comprises openings of 1.00 to 0.850 mm (18 to 20 mesh). It is also preferable that the mesh type material 106 for extrusion does nob melt under sintering temperatures, and have a minimum preformability under the pressure that makes this mesh multiusable.

FIGS. 22 and 23 of the drawings show an assembly and a sintered single layer cutting tool respectively. FIG. 22 illustrates the layers to be assembled, and includes a central porous layer 79 having a plurality of abrasive particles 80 in the openings thereof. It should be noticed that the particles 80 are at least as wide as the layer 79, so the particles 80 extend completely through the porous layer 79.

Each side of the central layer 79 includes two-SEDF preforms 81, 82 and 81', 82', separated by porous layers 84, 84'.

When the assembly is heated under pressure, the material shown in FIG. 23 results. The present inventor has used this method to produce abrasive articles with one layer of diamonds as shown. It should be understood, however, that the abrasive article can include as many layers as desired, in accordance with other disclosures herein.

FIGS. 24 and 25 show the production of a no-diamond foot on a conventional diamond segment. Current methods are difficult to use because the foot 85 is quite thin, requiring that powder be distributed very thinly, yet very uniformly, in a sinter mold. Using the methods and apparatus of the present invention, however, an SEDF preform 86 can be placed against the segment 88, and the retaining powder is readily distributed uniformly. As is discussed in detail above, the final thickness of the foot 85 car be easily calculated.

FIGS. 26 and 27 show the use of a conventional green compact having randomly distributed abrasive particles in combination with SEDF preforms of the present invention, and porous layers having orderly arranged abrasive particles. The central green compact 89 has a porous layer 90, 90' on each side thereof, then an SEDF preform 91, 91'. The outside comprises a porous, or cellular, layer 92, 92' having a plurality of abrasive particles 94, 94' distributed therein in an orderly fashion.

The assembly of FIG. 26 can be compressed in the direction indicated by the arrows 95, or in the direction indicated by the arrows 96 to form the product shown in FIG. 27. The inventor has used this technique, with pressure in the direction of the arrows 95, to manufacture diamond segments for saw blades, and a ream saw blade.

FIG. 28 illustrates the making of a cut-off disk. Individual pieces 98, or a complete ring, of the SEDF preform can be prepared of the proper shape, and placed around the periphery of a core 99. From the foregoing discussion it will be understood that the pieces 98 may include any number of layers, may or may not include porous layers, and may have as many or as few abrasive particles as desired.

After the pieces 98, or the ring, is assembled on the core 99, the assembly will be sintered (preferably under pressure) so the sintering of the preform and fixing the preform to the core 99 are performed in one step.

Following are some specific examples of use of the technology of the present invention:

1. a) Make an SEDF preform in the form of a plate or a tape from a binder composition and diamond retaining composition, e.g., from Wall Colmonoy's setting powder 50, or from Kennametal's powder N50, or from any other sinterable powdered composition suitable for use with abrasive articles. Do not mix these retaining powders with diamonds in the process of making SEDF preform.
   b) Cut the preform with paper cutter or scissors into the shape suitable for the sintering mold and design of the abrasive articles.
   c) Put diamonds into openings of the mesh type material and temporarily retain them with an adhesive carrier. As an option, the mesh type material can be then removed.
   d) Apply SEDF preform against the carrier that includes abrasive particles. As an option, pressure and/or adhesive can be applied to hold the assembly together. As another option, separators can be placed on at least one side of the assembly as disclosed in U.S. Pat. No. 5,203,880, "Method and Apparatus for Making Abrasive Tools".
   e) Place the assembly into a heating device e.g., between heating plates or into a sintering mold. It can be several assemblies per one device.
   f) Heat the assembly under a pressure, e.g., up to 1040° C. and 300 kg/cm$^2$, so called "hot compacting".
   g) Remove the sintered assembly from the device, clean and cut, if necessary, into pieces required by the design, then mount the pieces on a carrier, if necessary, to make the final product.
2. a) Make an SEDF preform in the form of a plate or a tape from a slurry mixture of a binder composition, diamond particles and a diamond retaining composition, e.g., from Wall Colmonoy's setting powder 50, or from Kennametal's powder N50, or from any other sinterable powdered composition suitable for use with abrasive articles.
   b) Cut the preform with paper cutter or scissors into the shape suitable for the sintering mold and design of the abrasive articles.
   c) As an option, separators can be placed on at least one side of the preform as disclosed in U.S. Pat. No. 5,203,880, "Method and Apparatus for Making Abrasive Tools", forming an assembly.
   d) Place the assembly into a heating device, e.g. between heating plates or into a sintering mold. It can be several assemblies per one device.
   e) Heat the assembly under pressure, e.g. up to 1040° C. and 300 kg/cm$^2$, so called "hot compacting".
   f) Remove the sintered assembly from the device, clean and cut, if necessary, into pieces required by the design, then mount the pieces on a carrier, if necessary, to make the final product.
3. a) Make an SEDF preform in the form of a plate or a tape from a slurry mixture of a binder composition, a first plurality of diamonds and a diamond retaining composition, e.g. from Wall Colmonoy's setting powder 50, or from Kennametal's powder N50, or from any other powdered composition suitable for use with abrasive articles.
   b) Cut the preform with paper cutter or scissors into the shape suitable for the sintering mold and design of the abrasive articles.
   c) Put a second plurality of diamonds into openings of the mesh type material and temporarily retain them with an adhesive carrier. As an option, the mesh type material can be then removed.
   d) Apply SEDF preform, including the first plurality of diamonds against the carrier including the second plurality of diamonds. As an option, pressure and/or adhesive can be applied to hold the assembly together. As another option, separators can be placed on at least one side of the assembly as disclosed in U.S. Pat. No. 5,203,880, "Method and Apparatus for Making Abrasive Tools".
   e) Place the assembly into a heating device, e.g. between heating plates or into a sintering mold. It can be several assemblies per one device.
   f) Heat the assembly under a pressure, e.g. up to 1040° C. and 300 kg/cm$^2$, so called "hot compacting".
   g) Remove the sintered assembly from the device, clean and cut, if necessary, into pieces required by the design, then mount the pieces on a carrier, if necessary, to make the final product.

It should be understood that the first and second pluralities of diamonds, and generally, any abrasive particles, can be of the same or different origin, size, shape and physical-mechanical parameters.

4. a) Make an SEDF preform in the form of a plate or a tape from a binder composition and diamond retaining composition, e.g. from Wall Colmonoy's setting powder 50, or from Kennametal's powder N50, or from any other sinterable powdered composition suitable for use with abrasive articles. Do not mix these retaining powders with diamonds in the process of making SEDF preform.
   b) Cut the preform with paper cutter or scissors into the shape suitable for the sintering mold and design of the abrasive articles.
   c) Take a nickel non-woven mat of National Standard, cut it into the proper pieces.
   d) Assemble a sandwich "SEDF preform—the nickel mat—SEDF preform". As an option, apply pressure and/or an adhesive to improve the integrity of this assembly.
   e) Put diamonds into openings of the mesh type material and temporarily retain with an adhesive carrier. As an option, the mesh type material can be then removed.

f) Apply this carrier including the abrasive particles against the sandwich "SEDF preform—the nickel mat—SEDF preform". As an option, pressure and/or adhesive can be applied to hold the assembly together. As another option, separators can be placed on at least one side of the assembly as disclosed in U.S. Pat. No. 5,203,880, "Method and Apparatus for Making Abrasive Tools".

e) Place the assembly into a heating device, e.g. between heating plates or into a sintering mold. It can be several assemblies per one device.

f) Heat the assembly under a pressure, e.g. up to 1040° C. and 300 kg/cm$^2$, so called "hot compacting".

g) Remove the sintered assembly from the device, clean and cut, if necessary, into pieces required by the design, then mount the pieces on a carrier, if necessary, to make the final product.

5. a) Make an SEDF preform in the form of a plate or a tape from a slurry mixture of a binder composition, the abrasive particles and a diamond retaining composition, e.g. from Wall Colmonoy's setting powder 50, or from Kennametal's powder N50, or from any other sinterable powdered composition suitable for use with abrasive articles.

b) Cut the preform with paper cutter or scissors into the shape suitable for the sintering mold and design of the abrasive articles.

c) Take a nickel non-woven mat of National Standard, cut it into the proper pieces.

d) Assemble a sandwich "SEDF preform—the nickel mat—SEDF preform". As an option, apply pressure and/or an adhesive to improve the integrity of this assembly. As another option separators can be placed on at least one side of the assembly as disclosed in U.S. Pat. No. 5,203,880, "Method and Apparatus for Making Abrasive Tools".

e) Place the assembly into a heating device, e.g. between heating plates or into a sintering mold. It can be several assemblies °per one device.

f) Heat the assembly under a pressure, e.g., up to 1040° C. and 300 kg/cm$^2$, so called "hot compacting".

g) Remove the sintered assembly from the device, clean and cut, if necessary, into pieces required by the design, then mount the pieces on a carrier, if necessary, to make the final product.

6. a) Make an SEDF preform in the form of a plate or a tape from a slurry mixture of a binder composition, the abrasive particles and a diamond retaining composition, e.g. from Wall Colmonoy's setting powder 50, or from Kennametal's powder N50, or from any other powdered composition suitable for use with abrasive articles.

b) Cut the preform with paper cutter or scissors into the shape suitable for the sintering mold and design of the abrasive articles.

c) Take a nickel non-woven mat of National Standard, cut it into the proper pieces.

d) Assemble a sandwich "SEDF preform—the nickel mat—SEDF preform". As an option, apply pressure and/or an adhesive to improve the integrity of this assembly.

e) Put diamonds into openings of the mesh type material and temporarily retain with an adhesive carrier. As an option, the mesh type material can be then removed.

f) Apply this carrier including the abrasive particles against the sandwich "SEDF preform—the nickel mat—SEDF preform". As an option, pressure and/or adhesive can be applied to hold the assembly together. As another option, separators can be placed on at least one side of the assembly as disclosed in U.S. Pat. No. 5,203,880, "Method and Apparatus for Making Abrasive Tools".

e) Place the assembly into a heating device, e.g. between heating plates or into a sintering mold. It can be several assemblies per one device.

f) Heat the assembly under a pressure, e.g. up to 1040° C. and 300 kg/cm$^2$, so called "hot compacting".

g) Remove the sintered assembly from the device, clean and cut, if necessary, into pieces required by the design, then mount the pieces on a carrier, if necessary, to make the final product.

It should be understood that the preferred embodiments of the invention here presented comprise assemblies of abrasive particles such as diamonds, cubic boron nitride or the like, distributed in an orderly fashion on a substrate, or a carrier, and a pre-made SEDF preform formed from metals, ceramics, epoxy materials with binders or other plastics. The assemblies of the above components are heated or sintered, preferably under an external pressure. The SEDF preform may or may not include randomly distributed abrasive particles therein; and, and a separator can be a part of the assembly itself to prevent contacting and/or diffusion between the SEDF preforms and the molding parts.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. In a method for making an abrasive article wherein a plurality of abrasive particles and a quantity of powdered sinterable matrix material are combined together and sintered to form the article, the improvement comprising forming a soft, easily deformable and flexible preform from a mixture of said quantity of powdered sinterable matrix material and a liquid binder composition, including a plurality of abrasive particles at least partially in said preform and then sintering said preform to form said abrasive article.

2. The method of claim 1, wherein the preform is sintered under pressure.

3. The method of claim 1, wherein the plurality of abrasive particles are included in the mixture of powdered sinterable matrix material and liquid binder composition before forming said preform.

4. The method of claim 1, wherein the plurality of abrasive particles are included in the preform by placing the particles on at least one side of said preform and urging the particles into said preform.

5. The method of claim 4, wherein the abrasive particles are urged into the preform before the preform is sintered.

6. The method of claim 4, wherein the abrasive particles are urged into the preform during sintering of the preform.

7. The method of claim 1, wherein the abrasive particles are randomly included in said preform.

8. The method of claim 1, wherein the abrasive particles are included in the preform in a non-random pattern.

9. The method of claim 1, wherein a portion of the abrasive particles is randomly included in said preform and another portion is non-randomly placed on at least one side of said preform and then urged into said preform.

10. The method of claim 1, wherein said soft, easily deformable and flexible preform is formed from a slurry or paste of said mixture of powdered sinterable matrix material and liquid binder composition, said liquid binder composition comprising at least a cement and a liquid volatile component therefor with the volume of the liquid binder composition in the mixture being greater than the volume of the powdered sinterable matrix material, the slurry or paste being formed into a substrate on a support surface, which substrate is thereafter cured to remove at least a portion of the liquid volatile component therefrom and form said preform.

11. The method of claim 10, wherein the plurality of abrasive particles are included in the preform by placing the particles on the support surface before the substrate is formed thereon.

12. The method of claim 11, wherein the abrasive particles are randomly placed on the support surface.

13. The method of claim 11, wherein the abrasive particles are placed on the support surface in a non-random pattern.

14. The method of claim 11, wherein the support surface includes a plurality of openings therein and the abrasive particles are placed in the openings of the support surface.

15. The method of claim 10, wherein the plurality of abrasive particles are included in the preform by placing the particles on a surface of the substrate opposite from the support surface before the substrate is cured.

16. The method of claim 15, wherein the abrasive particles are randomly placed on the surface of the substrate.

17. The method of claim 15, wherein the abrasive particles are placed on the surface of the substrate in a non-random pattern.

18. The method of claim 10, wherein the plurality of abrasive particles are included in the preform by placing the particles on one side of the preform after forming said preform and urging the particles into said preform.

19. The method of claim 2, including placing at least one porous layer against one side of said preform to form an assembly before sintering said preform under pressure, said assembly thereafter being sintered under pressure, whereby said porous layer is urged into said preform, said porous layer having a plurality of pores open to the surface thereof for restraining movement of said sinterable matrix material and abrasive particles during sintering of the assembly under pressure.

20. The method of claim 19, wherein the abrasive particles are included in the preform by placing the particles on a side of the porous layer, the particles and porous layer then being urged into the preform to at least partially include the plurality of abrasive particles in said preform during sintering of the assembly under pressure.

21. The method of claim 19, wherein the assembly includes a second preform placed against a side of said porous layer opposite from said one side of said porous layer before sintering said assembly, whereby said porous layer is located between and is urged into both said preforms during sintering of the assembly under pressure.

22. The method of claim 19, wherein the preform is formed on a surface of said porous layer.

23. The method of claim 22, wherein the abrasive particles are included in the preform by placing the particles on the porous layer before the preform is formed on the porous layer.

24. The method of claim 19, wherein the porous layer has a lower melting temperature than the sinterable matrix material.

25. The method of claim 24, wherein the porous layer at least partially melts during sintering of the assembly.

26. The method of claim 19, wherein the assembly includes a second porous layer placed against a side of said preform opposite from said one side of said preform before sintering said assembly, whereby said preform is located between both said porous layers, which porous layers are urged into said preform during sintering of the assembly under pressure.

27. The method of claim 19, including placing at least one layer of separator material on at least one side of said assembly before sintering said assembly under pressure and thereafter removing the layer of separator material from said assembly.

28. The method of claim 27, including placing a second layer of separator material on a side of said assembly opposite from said one side of said assembly before sintering said assembly under pressure and thereafter removing said second layer of separator material from said assembly.

29. The method of claim 24, including placing at least one layer of mesh material adjacent to said layer of separator material before sintering, whereby the mesh material is urged through said layer of separator material into said assembly during sintering of the assembly under pressure to form a profile of the mesh material on a side of the assembly and thereafter removing said layer of mesh material and layer of separator material from said assembly.

30. The method of claim 29, wherein the mesh material is a wire screen having an orderly distribution of openings therein.

31. The method of claim 29, wherein the mesh material is expanded metal.

32. The method of claim 29, including placing a second layer of separator material on a side of the mesh material opposite from said assembly before sintering of the assembly under pressure and thereafter removing both layers of separator material from said assembly.

33. The method of claim 32, including placing a third layer of separator material on a side of said assembly opposite from said one side of said assembly before sintering said assembly under pressure and thereafter removing said third layer of separator material from said assembly.

34. The method of claim 29, including placing a second layer of separator material on a side of said assembly opposite from said one side of said assembly and placing a second layer of mesh material adjacent to said second layer of separator material before sintering, whereby both layers of mesh material are urged through respective adjacent layers of separator material into said assembly during sintering of the assembly under pressure whereby a profile of the mesh material is formed on both sides of the assembly and thereafter removing both said layers of mesh and separator material.

35. The method of claim 34, wherein each layer of separator material is of a different thickness.

36. The method of claim 34, wherein each layer of mesh material is a different material.

37. The method of claim 2, including placing at least one layer of separator material on at least one side of said preform before sintering said preform under pressure and thereafter removing said layer of separator material from said preform.

38. The method of claim 37, including placing a second layer of separator material on a side of said preform opposite from said one side of said preform before sintering said preform under pressure and thereafter removing said second layer of separator material from said preform.

39. The method of claim 37, including placing at least one layer of mesh material adjacent to said layer of separator material before sintering, whereby the mesh material is urged through said layer of separator material during sintering of the preform under pressure to form a profile of the mesh material on a side of the preform and thereafter removing said layer of mesh material and layer of separator material from said preform.

40. The method of claim 39, wherein the mesh material is a wire screen having an orderly distribution of openings therein.

41. The method of claim 39, wherein the mesh material is expanded metal.

42. The method of claim 39, including placing a second layer of separator material on a side of the mesh material opposite from said preform before sintering of the preform under pressure and thereafter removing the second layer of separator material from said preform.

43. The method of claim 42, including placing a third layer of separator material on a side of said preform opposite from said one side of said preform before sintering said preform under pressure and thereafter removing said third layer of separator material from said preform.

44. The method of claim 39, including placing a second layer of separator material on a side of said preform opposite from said one side of said preform and placing a second layer of mesh material adjacent to said second layer of separator material before sintering, whereby both layers of mesh material are urged through respective adjacent layers of separator material into said preform during sintering of the preform under pressure whereby a profile of the mesh material is formed on both sides of the preform and thereafter removing both said layers of mesh and separator material.

45. The method of claim 44, wherein each layer of separator material is of a different thickness.

46. The method of claim 44, wherein each layer of mesh material is a different material.

47. The method of claim 2, wherein the plurality of abrasive particles are included in the preform by randomly distributing the particles in a layer of green compacted sinterable matrix material, the method including the step of placing one side of this layer against said preform to form an assembly and thereafter sintering said assembly under pressure to form said abrasive article.

48. The method of claim 47, wherein the assembly further includes a second preform placed against a side of said layer opposite from said one side of said layer of green compacted sinterable matrix material before sintering said assembly under pressure.

49. The method of claim 47, wherein the assembly includes a layer of porous material placed against each of said preforms, said porous layers having pores open to the surface thereof and being urged into said preforms during sintering of said assembly under pressure.

50. The method of claim 47, wherein additional abrasive particles are located in the porous layers in a non-random manner before sintering.

51. The method of claim 1, wherein the thickness of the preform before sintering thereof is 3 to 10 times the particle size of the abrasive particles.

52. The method of claim 10, wherein the volume of the powdered sinterable matrix material in said mixture is from 0.3 to 10%.

53. The method of claim 10, wherein the weight of the liquid binder composition in said mixture is from 3 to 20%.

54. The method of claim 53, wherein the weight of the liquid binder composition in said mixture is from 5.0 to 8.5%.

55. The method of claim 10, wherein the cement is rubber cement.

56. An abrasive product produced by the method of claim 19.

57. An abrasive product produced by the method of claim 29.

58. An abrasive product produced by the method of claim 34.

59. An abrasive product produced by the method of claim 39.

60. An abrasive product produced by the method of claim 44.

61. An abrasive product produced by the method of claim 49.

62. An abrasive product produced by the method of claim 50.

* * * * *

UNITED STATES PATENT AND TRADEMARK OFFICE

CERTIFICATE OF CORRECTION

PATENT NO. : 5,620,489
DATED : April 15, 1997
INVENTOR(S) : Naum N. Tselesin

It is certified that error appears in the above-indentified patent and that said Letters Patent is hereby corrected as shown below:

Title page, item [54]
In the title "THEREFORM" should read --THEREFROM--.
Column 1, line 3, in the title "THEREFORM" should read --THEREFROM--.
Claim 29, line 1, "24" should read --27--.

Claim 49, line 1, "47" should read --48--.

Claim 50, line 1, "47" should read --48--.

Signed and Sealed this
Seventh Day of April, 1998

Bruce Lehman

*Attest:*

BRUCE LEHMAN

*Attesting Officer*

*Commissioner of Patents and Trademarks*

US005620489C1

(12) EX PARTE REEXAMINATION CERTIFICATE (5186th)

United States Patent

Tselesin

(10) Number: US 5,620,489 C1

(45) Certificate Issued: Aug. 23, 2005

(54) METHOD FOR MAKING POWDER PREFORM AND ABRASIVE ARTICLES MADE THEREFROM

(75) Inventor: Naum N. Tselesin, Atlanta, GA (US)

(73) Assignee: Ultimate Abrasive Systems, L.L.C., Tucker, GA (US)

Reexamination Request:
No. 90/006,587, Mar. 31, 2003

Reexamination Certificate for:

| | |
|---|---|
| Patent No.: | **5,620,489** |
| Issued: | **Apr. 15, 1997** |
| Appl. No.: | **08/594,388** |
| Filed: | **Jan. 31, 1996** |

Certificate of Correction issued Apr. 7, 1998.

Related U.S. Application Data

(63) Continuation of application No. 08/225,251, filed on Apr. 8, 1994, now abandoned.

(51) Int. Cl.[7] ..... B24D 18/00

(52) U.S. Cl. ..... 51/293; 51/298; 51/299; 51/307

(58) Field of Search ..... 51/293, 298, 299, 51/307, 308, 309

(56) References Cited

U.S. PATENT DOCUMENTS

| | | | |
|---|---|---|---|
| 2,220,281 | A | 5/1940 | Koebel |
| 2,555,001 | A | 5/1951 | Ohl |
| 2,612,348 | A | 9/1952 | Catallo |
| 2,908,072 | A | 10/1959 | Johnson |
| 2,952,951 | A | 9/1960 | Simpson |
| 3,293,012 | A | 12/1966 | Smiley et al. |
| 3,630,699 | A | 12/1971 | Catlin |
| 3,645,728 | A | 2/1972 | Hrinevich, Jr. |
| 3,653,884 | A | 4/1972 | Davies et al. |
| 3,796,563 | A | 3/1974 | Wieland, Jr. et al. |
| 3,839,026 | A | 10/1974 | Gibbon et al. |
| 3,894,673 | A | 7/1975 | Lowder et al. |
| 4,017,480 | A | 4/1977 | Baum |
| 4,018,576 | A | 4/1977 | Lowder et al. |
| 4,121,928 | A | 10/1978 | Mori |
| 4,158,689 | A | 6/1979 | Pett et al. |
| 4,194,040 | A | 3/1980 | Breton et al. |
| 4,211,294 | A | 7/1980 | Multakh |
| 4,228,214 | A | 10/1980 | Steigelman et al. |
| 4,249,955 | A | 2/1981 | Grab et al. |
| 4,355,489 | A | 10/1982 | Heyer et al. |
| 4,409,054 | A | 10/1983 | Ryan |
| 4,428,755 | A | 1/1984 | Ohno |
| 4,453,951 | A | 6/1984 | Ohno |
| 4,652,277 | A | 3/1987 | Makhlouf et al. |
| 4,669,522 | A | 6/1987 | Griffin |
| 4,678,717 | A | 7/1987 | Nickola et al. |
| 4,734,237 | A | 3/1988 | Fanelli et al. |
| 4,749,594 | A | 6/1988 | Malikowski et al. |
| 4,780,274 | A | 10/1988 | Barr |
| 4,866,885 | A | 9/1989 | Dodsworth |
| 4,883,500 | A | 11/1989 | Deakins et al. |
| 4,908,046 | A | 3/1990 | Wiand |
| 4,916,869 | A | 4/1990 | Oliver |
| 4,925,457 | A | 5/1990 | deKok et al. |
| 4,933,211 | A | 6/1990 | Sauvinet et al. |
| 4,945,686 | A | 8/1990 | Wiand |
| 4,949,511 | A | 8/1990 | Endo et al. |
| 4,952,251 | A | 8/1990 | Iwasaki et al. |
| 4,963,388 | A | 10/1990 | Benoit |

(Continued)

FOREIGN PATENT DOCUMENTS

| | | |
|---|---|---|
| AT | 678797 | 9/1952 |
| DE | 269333 A1 | 11/1911 |
| DE | 18 17 586 | 7/1970 |
| DE | 22 56 079 | 3/1974 |
| DE | 24 48 738 A1 | 4/1976 |
| DE | 26 43 954 A1 | 3/1978 |
| DE | 26 50 942 | 5/1978 |
| DE | 29 22 152 A1 | 12/1980 |
| DE | 36 11 271 A1 | 10/1987 |
| DE | 15 33 035 | 4/1997 |
| EP | 0 056 945 | 8/1982 |
| EP | 0 179 602 A1 | 4/1986 |
| EP | 0 324 513 A1 | 7/1989 |
| EP | 0 357 378 B1 | 12/1993 |
| GB | 707156 | 4/1954 |

(Continued)

OTHER PUBLICATIONS

Invalidation Appeal No. 2003–35161 for Japanese Patent No. 3,294,277: Minutes of 1st Oral Hearing, Mar. 5, 2004.

Invalidation Appeal No. 2003–35161 for Japanese Patent No. 3,294,277: Outline of Statement for Oral Hearing, Mar. 5, 2004.

Invalidation Appeal No. 2003–35161 for Japanese Patent No. 3,294,277: Comments of JPO Appeal Board, Dec. 22, 2003.

Invalidation Appeal No. 2003–35161 for Japanese Patent No. 3,294,277: Reply Brief, Nov. 12, 2003.

Invalidation Appeal No. 2003–35161 for Japanese Patent No. 3,294,277: JPO Final Decision, Apr. 5, 2004.

Decision in *Kinik Company* v. *U.S. International Trade Commission and Minnesota Mining and Manufacturing Co. and Ultimate Abrasive Systems, L.L.C.*, Ct. of Appeal for Fed. Cir., No. 02–1550, decided Mar. 25, 2004.

(Continued)

*Primary Examiner*—Michael A Marcheschi

(57) ABSTRACT

A method for making abrasive articles uses a soft, easily deformable and flexible preform having a high binder content. The binder gives the preform its integrity, and is present in greater quantity than the retaining powder. The preform can have superabrasive particles mixed therein, or added later. The preform allows even distribution of a small quantity of retaining powder for thin superabrasive articles. A porous layer may be added to the assembly for making an abrasive article, the porous layer absorbing the liquid binder, supporting the retaining powder and superabrasive particles to prevent lateral movement, and perhaps giving strength to the preform. The final assembly to be heated or sintered (preferably under pressure) for making the abrasive article, which may include any number of layers of superabrasive particles, porous layers and preforms.

U.S. PATENT DOCUMENTS

| | | | |
|---|---|---|---|
| 4,968,326 | A | 11/1990 | Wiand |
| 4,968,327 | A | 11/1990 | Efros et al. |
| 4,997,460 | A | 3/1991 | Satake et al. |
| 5,000,273 | A | 3/1991 | Horton et al. |
| 5,022,895 | A | 6/1991 | Wiand |
| 5,030,276 | A | 7/1991 | Sung et al. |
| 5,037,453 | A | 8/1991 | Narayanan et al. |
| 5,049,165 | A | 9/1991 | Tselesin |
| 5,092,910 | A | 3/1992 | deKok et al. |
| 5,094,671 | A | 3/1992 | Hall et al. |
| 5,096,466 | A | 3/1992 | Satake et al. |
| 5,107,626 | A | 4/1992 | Mucci |
| 5,110,322 | A | 5/1992 | Narayanan et al. |
| 5,131,924 | A | 7/1992 | Wiand |
| 5,133,782 | A | 7/1992 | Wiand |
| 5,142,785 | A | 9/1992 | Grewal et al. |
| 5,143,523 | A | 9/1992 | Matarrese |
| 5,160,509 | A | 11/1992 | Carman et al. |
| 5,162,063 | A | 11/1992 | Shinoda et al. |
| 5,177,910 | A | 1/1993 | Norota et al. |
| 5,197,249 | A | 3/1993 | Wiand |
| 5,203,880 | A | 4/1993 | Tselesin |
| 5,203,881 | A | 4/1993 | Wiand |
| 5,203,882 | A | 4/1993 | Carman et al. |
| 5,221,924 | A | 6/1993 | Wilson, Jr. |
| 5,230,138 | A | 7/1993 | Shiga et al. |
| 5,236,533 | A | 8/1993 | Imai et al. |
| 5,247,765 | A | 9/1993 | Quintana |
| 5,248,528 | A | 9/1993 | Robbins et al. |
| 5,264,011 | A | 11/1993 | Brown et al. |
| 5,266,236 | A | 11/1993 | Bovenkerk |
| 5,292,478 | A | 3/1994 | Scorey |
| 5,342,563 | A | 8/1994 | Quinn et al. |
| 5,368,618 | A | 11/1994 | Masmar et al. |
| 5,380,179 | A | 1/1995 | Nishimura et al. |
| 5,380,390 | A | 1/1995 | Tselesin |
| 5,403,544 | A | 4/1995 | Adrian et al. |
| 5,418,056 | A | 5/1995 | Noguchi et al. |
| 5,418,069 | A | 5/1995 | Learman |
| 5,429,648 | A | 7/1995 | Wu |
| 5,445,788 | A | 8/1995 | Turenne et al. |
| 5,451,365 | A | 9/1995 | Barsoum |
| 5,453,106 | A | 9/1995 | Roberts |
| 5,472,461 | A | 12/1995 | Li |
| 5,476,632 | A | 12/1995 | Shivanath et al. |
| 5,518,443 | A | 5/1996 | Fisher |
| 5,525,293 | A | 6/1996 | Kagawa et al. |
| 5,536,282 | A | 7/1996 | Yoon et al. |
| 5,560,745 | A | 10/1996 | Roberts |
| 5,567,746 | A | 10/1996 | Gay |
| 5,578,099 | A | 11/1996 | Neff |
| 5,605,499 | A | 2/1997 | Sugiyama et al. |
| 5,711,840 | A | 1/1998 | Johnson |
| RE35,812 | E | 6/1998 | Oliver |
| 5,791,330 | A | 8/1998 | Tselesin |
| 5,817,204 | A | 10/1998 | Tselesin |

FOREIGN PATENT DOCUMENTS

| | | |
|---|---|---|
| GB | 1016032 | 1/1966 |
| JP | 9394 | 12/1955 |
| JP | 48-33076 | 10/1973 |
| JP | 53-148791 | 12/1978 |
| JP | 55-85483 | 6/1980 |
| JP | 57-501027 | 6/1982 |
| JP | 58-48663 | 3/1983 |
| JP | 60071166 A | 4/1985 |
| JP | 60-177101 | 9/1985 |
| JP | 63-93567 | 4/1988 |
| JP | 63-143206 | 6/1988 |
| JP | 63-35389 | 7/1988 |
| JP | 1-150501 | 6/1989 |
| JP | 2-170902 | 7/1990 |
| JP | 2-252660 | 10/1990 |
| JP | 3-131475 | 6/1991 |
| JP | 3-268867 | 11/1991 |
| JP | 5-116073 | 5/1993 |
| SU | 1007952 | 3/1983 |
| SU | 1227443 | 4/1986 |
| SU | 1333563 A1 | 8/1987 |
| SU | 1620285 A1 | 1/1991 |
| WO | WO 91/08864 | 6/1991 |

OTHER PUBLICATIONS

"Combined Petition for Panel Rehearing and Rehearing En Banc by Intervenors", in *Kinik Company* v. *U.S. International Trade Commission and Minnesota Mining and Manufacturing Co. and Ultimate Abrasive Systems, L.L.C.*, Ct. of Appeal for Fed. Cir., No. 02–1550, filed Apr. 20, 2004.

"Motion for Leave to Supplement Addendum to Petition of Rehearing and Rehearing En Banc", in *Kinik Company* v. *U.S. International Trade Commission and Minnesota Mining and Manufacturing Co. and Ultimate Abrasive Systems, L.L.C.*, Ct. of Appeal for Fed. Cir., No. 02–1550, filed Apr. 23, 2004.

Order from U.S. Court of Appeals fro the Federal Circuit, *Kinik Company* v. *ITC*, 02–1550 (May 13, 2004).

Administrative Law Judge's Initial Determination (Public Version), (no date).

Kinik's Petition for Review of Initial Determination (Public Version), (no date).

Final ITC Decision Declining to Review [i.e., Adopting] Initial Determination (Public Version), (no date).

ITC Decision Entering Exclusion Order and Cease and Desist Order, (no date).

Kinik's Appeal Brief to the Federal Circuit (Public Version), (no date).

3M's Appeal Brief to the Federal Circuit (Public Version), (no date).

ITC's Appeal Brief to the Federal Circuit (Public Version), (no date).

Kinik's Reply Brief to the Federal Circuit (Public Version), (no date).

Opinion of Professor Williamson, (no date).

R. German, "Contiguity of Liquid–Phase Sintered Microstructures," *Metallurgical Trans.*, v. 16A (1985), pp. 1247–1252, no month.

R. German, "Connectivity of Liquid–Phase Sintered Microstructures," *Metallurgical Trans.*, v. 18A (1985), pp. 909–914, no month.

R. German, "Supersolidus Liquid–Phase Sintering Part I: Progress Review," *Int'l J. of Powder Metallurgy*, v. 26 (1990), pp. 23–24, no month.

Rabin et al., "Characterization of Liquid–Phase Sintered Composite Microstructures," *Microstructural Science*, v. 15 (1986), pp. 285–299, no month.

Zovas et al., "Activated and liquid–phase sintering," *J. of Metals*, v. 35, No. 1 (1983), p. 28, no month.

Order No. 23: Denying Kinik's Motion for Summary Determination that the Asserted Claims are Invalid and Not Infringed, dated Sep. 12, 2001.

Pre–hearing Brief of the Commission Investigating Staff, dated Sep. 14, 2001.

Post–Hearing Reply Brief of the Commission Investigating Staff, dated Nov. 16, 2001.

Post–Hearing Brief of the Commission Investigating Staff, dated Nov. 6, 2001.

Respondent Kinik Company's Notice of Appeal and Appeal of Order No. 40 that Erroneously Precluded Kinik from Presenting its non–Infringement Defense in this Investigation, dated Feb. 21, 2002.

Respondent Kinik Company's Post–Hearing Brief, dated Nov. 6, 2001.

Dr. Naum Tselesin, "Improvements of Diamond Tools for the Machining of Advanced Engineered Ceramics", Using Advanced Ceramics in Manufacturing Applications Conference, Jun. 3–5, 1991, Cincinnati, OH.

Mar. 25, 2004, Decision of United States Court of Appeals for the Federal Circuit, *Kinik Company, Appellant*, v. *International Trade Commission, Appellee, and Minnesota Mining and Manufacturing Company and Ultamate Abrasive Systems, L.L.C., Intervenors*.

Abrasive Materials Text, Len–Pong Chi, published Jun. 1984 by Kinik Company, p. 250.

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–62 is confirmed.

* * * * *